US005649639A

United States Patent [19]

Dolvet et al.

[11] Patent Number: 5,649,639

[45] Date of Patent: Jul. 22, 1997

[54] VENTED CONTAINER FOR FLOWABLE MEDIA

[75] Inventors: Franck Dolvet; Francis Herrmann, both of Phalsbourg, France

[73] Assignee: Sotralentz S.A., Drulingen, France

[21] Appl. No.: 390,918

[22] Filed: Feb. 17, 1995

[30] Foreign Application Priority Data

Feb. 22, 1994 [DE] Germany ..... 9402869 U
Aug. 3, 1994 [DE] Germany ..... 9412523 U

[51] Int. Cl.[6] ..... B65D 51/20

[52] U.S. Cl. ..... 220/257; 220/203.11; 220/203.28; 220/284; 220/303; 220/304; 220/371; 220/374

[58] Field of Search ..... 220/203.11, 203.28, 220/257, 284, 303, 304, 371, 373, 374

[56] References Cited

U.S. PATENT DOCUMENTS

| | | | |
|---|---|---|---|
| 1,841,691 | 1/1932 | Wilson | 220/371 |
| 1,875,428 | 9/1932 | Draper | 220/284 |
| 2,258,019 | 10/1941 | Kramer et al. | 220/371 X |
| 2,675,093 | 4/1954 | McCall et al. | 220/371 X |
| 3,393,823 | 7/1968 | Dearing | 220/304 X |
| 4,696,409 | 9/1987 | Vize | 220/203 |
| 5,065,883 | 11/1991 | Udell | 220/276 |
| 5,111,955 | 5/1992 | Baker et al. | 220/303 |

*Primary Examiner*—Stephen K. Cronin
*Attorney, Agent, or Firm*—Herbert Dubno

[57] ABSTRACT

A venting container prevents the incursion of contaminants and water during the breathing of the contents and has a central body received in a collar in the top wall of the container and adapted to accommodate a filter element. The central body is secured to a cover which is provided with break-away means signalling improper opening of the container and with a protective cap turned toward the interior thereof.

17 Claims, 4 Drawing Sheets

VENTED CONTAINER FOR FLOWABLE MEDIA

FIELD OF THE INVENTION

Our present invention relates to a container for a flowable medium or substance, especially a blow-molded container of synthetic resin, which can be used to store and dispense a flowable substance and is provided at its upper side or top with a venting device. The invention also relates to the venting device itself.

BACKGROUND OF THE INVENTION

Vented containers for flowable substances are, of course, known. For the purposes of the present invention, a flowable substance will be understood to be a liquid of greater or lesser viscosity or a flowable pulverulent or fine granular substance.

The term "venting device" is here used to mean a device which allows pressure equalization between the interior of the container and the ambient exterior thereof, i.e. which limits superatmospheric pressure build-up in the container as well as the development of subatmospheric pressures therein. A pressure build-up or a subatmospheric pressure can develop, for example, when the volume of the flowable medium in the container changes with, for example, temperature. The fluctuations in the volume of the mass within the container cause the package to "breathe" through the venting device. Containers with such venting devices are also used for adhesives.

A container of the basic type described above can have, at a lower portion of a side wall, a discharge opening and a venting device in the top wall. In the simplest case, the venting device is provided as a bore of small diameter in a cover which can be screwed onto a collar surrounding an opening, e.g. a filling opening, in the top wall of the container. During the "breathing" of the contents of the container with such a system, however, it is not possible to exclude the passage of contaminants or water into the interior.

OBJECTS OF THE INVENTION

It is, therefore, the principal object of the present invention to provide an improved vented container for a flowable substance which does not allow the incursion of finely divided contaminants or water and which nevertheless provides reliable venting.

Another object of the invention is to provide an improved vented container which is free from drawbacks of earlier systems.

SUMMARY OF THE INVENTION

These objects and others which will become apparent hereinafter are attained, in accordance with the invention, in a vented container, especially a container having a blow-molded receptacle composed of a synthetic resin or plaster, for a flowable substance having a collar provided with a collar opening and a venting device received in that opening.

According to the invention, the venting device comprises a cylindrical central body with a bottom which directly or through the intermediary of a screw-type cover is received in the collar opening and has an annular flange engaging a sealing ring which is applied to the collar. A filter substance is disposed in the central body and a protective cap, which is fastened on the bottom of the central body, is provided with at least one passage. A flat cover having joining elements connecting it to the annular flange of the central body is applied above the latter and, in the region of the joining elements, slit-like spaces are provided connecting the interior of the hollow body with the exterior of the receptacle to form the venting passages.

According to the invention, moreover, the cylindrical central body, the protective cap and the flat cover are joined together and the flat cover is provided with a break-away element providing security against improper opening when the break-away element ruptures upon opening of the cover.

The cylindrical central body, the protective cap and the flat cover can be formed from a synthetic resin or plastic material. The joining of these parts can be a form-fitting connection or a bonding of the materials of the parts together, e.g. locking of the parts or a fusion or welding of them. The bottom of the central body can be formed with at least one filtering opening and the passage in the cap can be formed by a cutout or a bore.

The vented container thus can comprise:

- a receptacle having a top wall formed with a circular cross section collar surrounding a collar opening;
- a hollow cylindrical central body received in the collar opening and formed with a bottom provided with at least one aperture communicating with an interior of the receptacle, and an annular flange at an upper end of the body engaging against an annular seal on the collar;
- a filter element in the central body;
- a protective cap fixed on the bottom of the central body and provided with at least one passage connecting the aperture with the interior of the receptacle;
- a flat cover overlying the upper end of the central body, surrounding the flange and connected therewith by joining elements, the cover being formed in regions between the joining elements with venting slits communicating between an inner space of the central body and ambient atmosphere externally of the collar and the cover, the cylindrical central body, the protective cap and the cover being connected together; and
- a break-away element connected to the cover and rupturing upon opening of the cover.

The invention thus utilizes a venting device which includes the central body, protective cap and flat cover defining a space in which a filter material is received, e.g. in the form of a cartridge, thereby preventing finely-divided impurities from penetrating into the interior of the receptacle during breathing of the flowable substance received therein. A flat cover protects the venting device and functions simultaneously as security against uncontrolled opening.

On the upper side of the flat cover, we can provide recesses for receiving a complementary tool for opening of the cover.

Using the venting device of the invention it is possible to allow a slight and controlled pressure build-up or a slight or controlled subatmospheric pressure to develop. For this purpose, the bottom of the central body can be provided with apertures upon which a mat or fleece providing a defined flow resistance can be applied. The top of the central body can, alternatively, or in addition, be provided with such a fleece or mat controlling the flow resistance.

The venting device of the invention thus allows the contents of the vessel to breathe without the incursion of contaminants or moisture.

If the outlet of the bottom of the receptacle is provided with a closure, e.g. a cock, the venting device can also be used for controlled inlet of air while the flowable substance is discharged through the outlet. In this case, the openings providing the air passage must have an appropriate diameter and, upon removal of the cover, the filter substance can be extracted from its chamber to increase flow rate.

According to the invention, the break-away element can be formed on the cover and connected to the collar. The cap can be of conical configuration or spherical segmental configuration and can be concave or convex toward the interior.

The break-way element can be a sheet or foil cap fastened onto the cover and the central body can extend toward the interior beyond the bottom to define an upper chamber containing the filter element above the bottom and a lower chamber below the bottom. The vented container further can comprise a check valve between the upper and lower chambers. The protective cap can be fitted to the body below the check valve. As has already been noted, the central body can be provided on a screw cover adapted to be threaded onto the collar.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
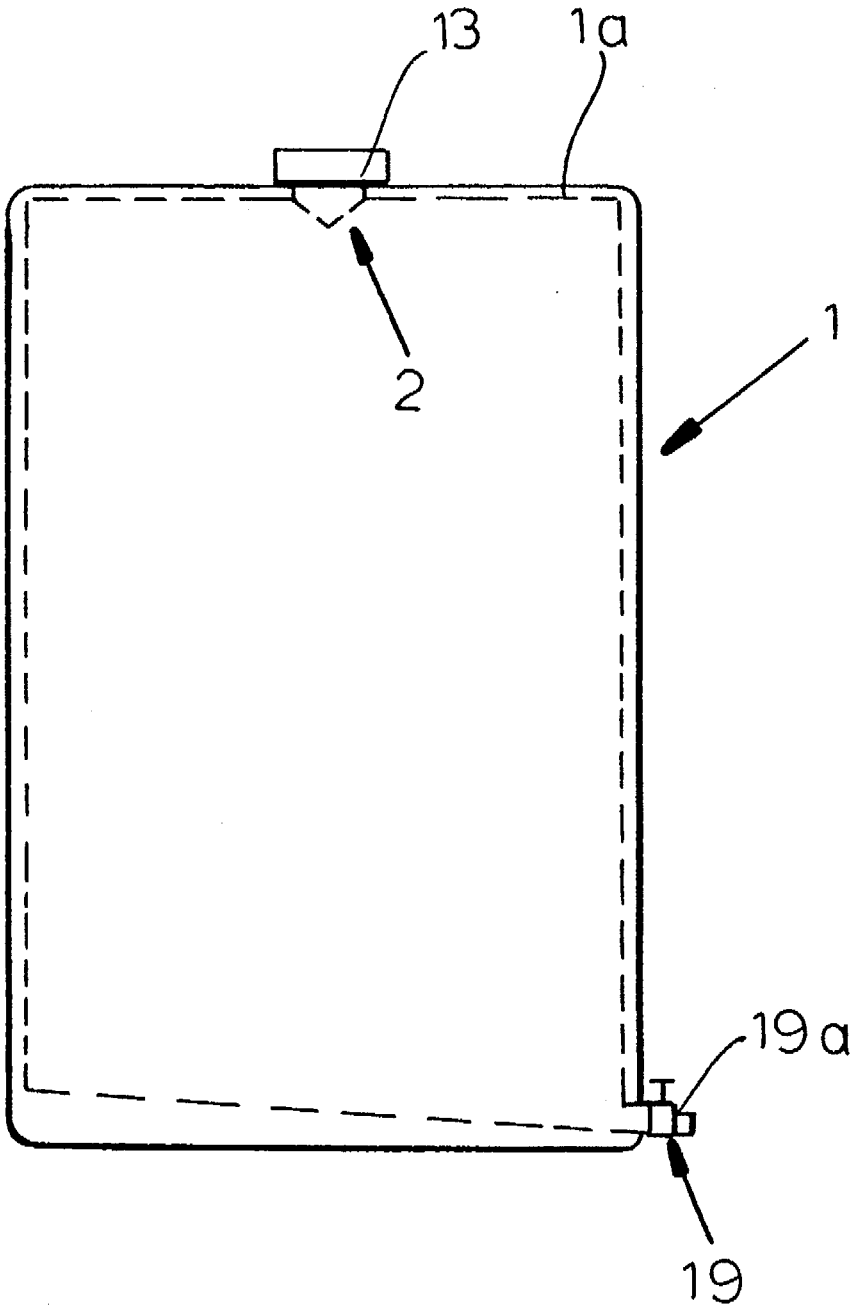
FIG. 1 is a diagrammatic elevational view of a container provided with a venting device according to the invention.

The container 1 shown in FIG. 1 comprises a blow-molded receptacle 1 composed of a synthetic resin and provided at its bottom along one side wall with an outlet fitting 19 which can have a cock 19*a*. The receptacle is intended to receive a flowable medium such as a liquid or a flowable solid and is provided with a top wall 1*a* having a venting device 2 fitted into and onto a collar thereof. A cover for the venting device is represented at 13.

Figure 2:
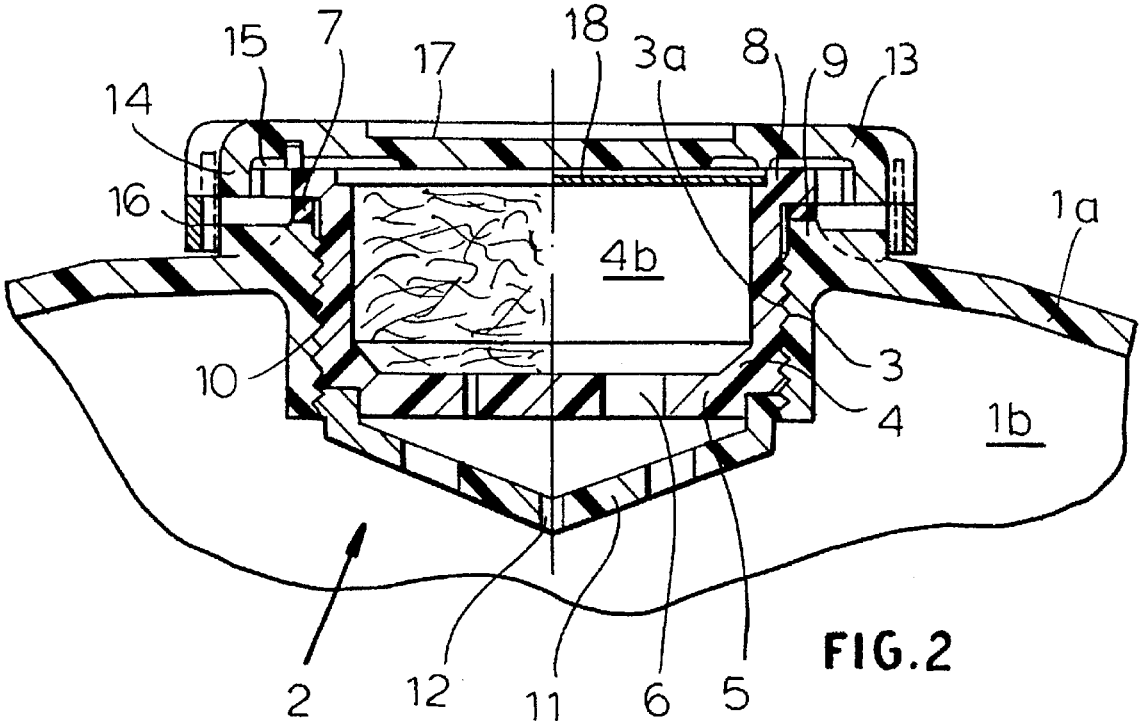
FIG. 2 is a cross sectional view of a venting device which can be used for the container of FIG. 1 drawn to a larger scale.
Figure 3:
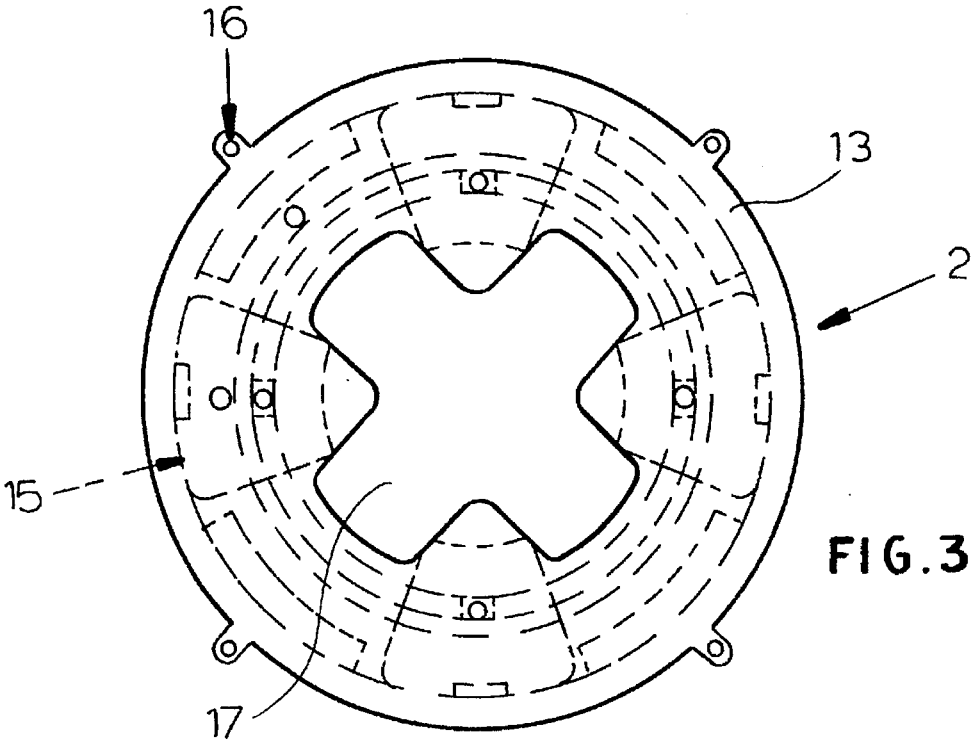
FIG. 3 is a plan view of the venting device of FIG. 2.

Turning to FIGS. 2 and 3, it can be seen that the upper wall 1*a* of a receptacle, such as that shown in FIG. 1 but of any other configuration, can have a collar 9 provided with a central circular, cross section collar opening 3 communicating between the interior 1*b* of the receptacle and the ambient atmosphere or exterior thereof and closed by the venting device 2.

The venting device 2 can comprise a cylindrical central body 4 which can fit into the opening 3 or can be externally threaded so as to engage an internal thread along the inner surface of the collar 9, i.e. the thread 3*a* shown in FIG. 2.

The central body 4 is hollow, having a compartment 4*b* terminating in a bottom 5 provided with at least one filtering aperture 6. An annular flange 8 of the body 4 rests on the collar 9 through an intermediary of a sealing ring 7. Within the compartment 4*b* a filter substance 10 is provided, e.g. as a filter cartridge which can be removed from the compartment 4*b* if desired, e.g. for emptying of the receptacle 1*b* as will be described hereinafter.

Below the central body 4 a conical protective cap 11 is provided, the cap 11 being convex toward the interior of the receptacle and being provided with at least one passage 11 communicating between the space below the bottom 5 and the space within the receptacle 1*b*.

Figure 2B:
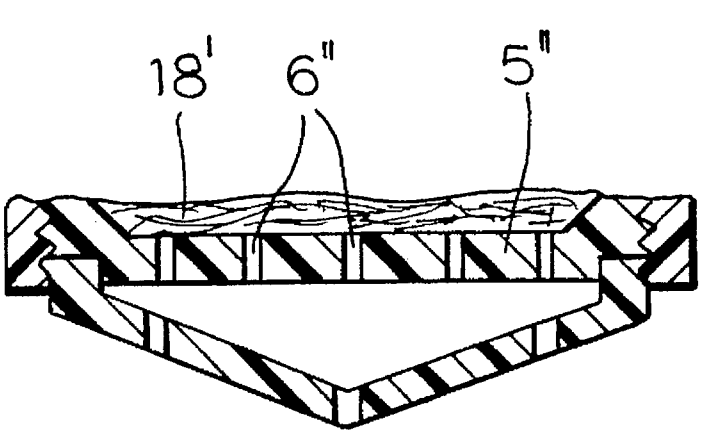
FIGS. 2A and 2B are cross sectional views of modifications of the device of FIG. 2.
Figure 2A:
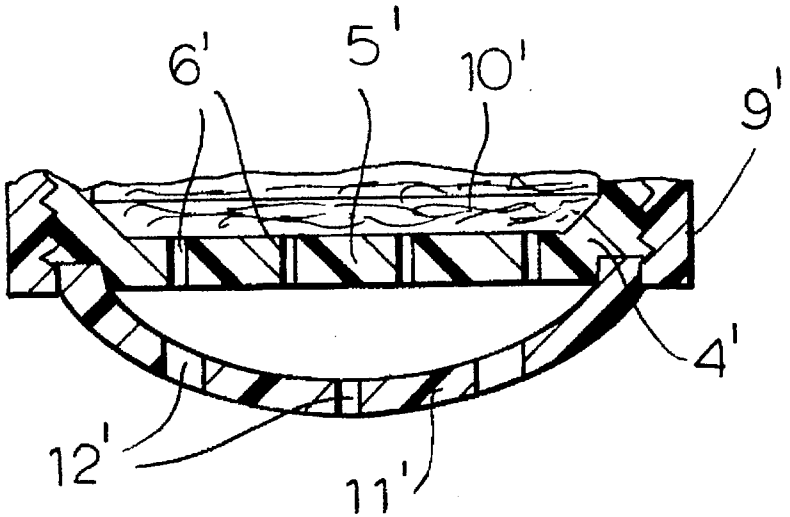
Figure 4:
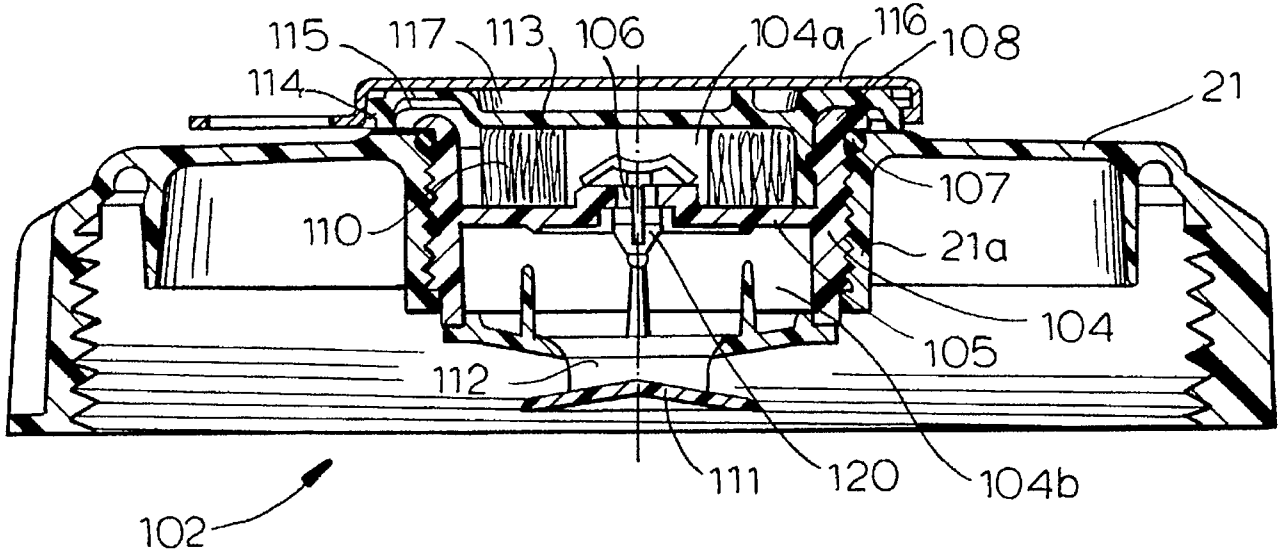
FIG. 4 is a view similar to FIG. 2 of another embodiment of the venting device.
Figure 5:
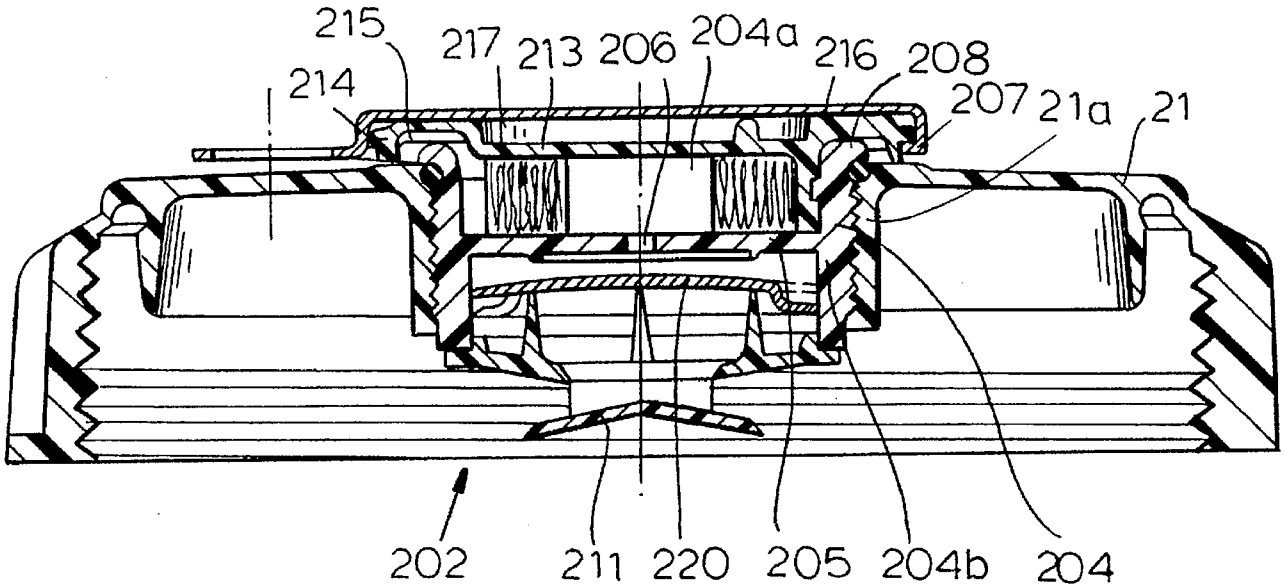
FIG. 5 is another view similar to FIG. 2 and yet another embodiment of a venting device according to the invention.

As can be seen from FIG. 2*a*, instead of the conical cap 11, a spherical segmental cap 11' can be provided with at least one passage 12', this cap being secured to the central body 4' at its bottom 5' provided with the filter opening 6' and the filter cartridge 10'. The central body 4' is here threaded into the collar 9' in the top wall of the receptacle. While the caps 11 and 11' are both convex toward the interior of the receptacle, the caps shown in FIGS. 4 and 5 are concave toward the interior.

At least one passage 12 or 12' should be provided at the lowest point of the cap 11 or 11'.

The assembly also includes a generally flat cover 13 which has joining elements 14 surrounding the flange 8 of the central body 4 and connected thereto. In regions between the joining elements 14, slits 15 can be provided for venting, the slits communicating between the exterior and the interior 1*b* through the filter cartridge 10, the apertures 6 and the passages 12.

The cylindrical central body 4, the protective cap 11 and the flat cover 13 are connected together by welding. The cover 13 is secured to the collar 9 by break-away elements 16 which, upon rotation of the cover 13, are ruptured and reveal, by their rupture, that the cover has been opened. In particular, the break-away elements 16 are pins which extend from the collar 9 into lugs spaced about the cover 13.

The cylindrical central body 4, the protective cap 11 and the cover 13 are composed of synthetic resin or plastic material. The cover 13 is formed on its upper side with recesses 17 into which a complementary tool can engage to force open the cover and thereby rotate the body 4 out of the collar 9. When desired, a break-away construction can be provided between the cover and the central body to allow separation of the two and removal of the filter element 10.

As can be seen on the right hand side of FIG. 2, where the filter cartridge has been omitted, a mat or other filter element 18 can be provided to constitute a controlled flow rate member which regulates the rate of flow of air into and out of the receptacle.

In FIG. 2*b*, a similar member 18' overlies the bottom 5" and covers the apertures 6". In this manner, a permissible slight superatmospheric pressure can be established therein. If the openings in the bottom 5, 5', 5" are of sufficiently large diameter and the filter substance is omitted or removed, the venting device 2 can also be used to admit air to the receptacle during discharge of the flowable substance therefrom via the fittings 19.

In the embodiments of FIGS. 4 and 5, the vent devices 102 and 202 are provided with threaded covers 21 which can be screwed onto external screw threads of a collar of a receptacle as shown in FIG. 1.

Here the security against improper opening is formed by a sheet metal or foil cap 116, 216, fastened on the flat cover 113, 213. The cover 21 is formed with an internal collar 21*a* to which the respective cylindrical central body 104, 204 may be connected by a screwthread and sealed by an O-ring 107, 207 braced against the outwardly-extending annular flange 108, 208.

The covers 113, 213 are connected at 114 and 214 with the cylindrical hollow bodies 104, 204 with slits 115, 215 between the joining elements 114, 214 serving to vent the interior of the hollow body 104, 204. The recesses 117 and 217 serve to enable a tool to engage the respective covers 113, 213 once the foil protective cap 116, 216 has been removed.

In both embodiments, the bottom 105, 205 subdivides the hollow body 104, 204 into an upper central chamber 104*a*, 204*a* receiving an annular filter cartridge 110, 210, and a lower compartment 104*b*, 204*b* opening toward the interior of the receptacle and closed by a respective cap 111, 211. The cap 111, 211 is welded to the respective body 104, 204 below a respective check valve 120 or 220. The check valves 120 and 220 are designed to allow the contents of the receptacle to "breathe" in the sense described above without permitting a rush or air into the receptacle until the cover 113, 213 is removed with the body 104, 204. The protective cap 111, 211 which prevents the contents of the vessel from blocking any passage in the bottom 105, 205 in normal use, can be formed with cutouts 112, 212.

We claim:

1. A vented container for a flowable substance comprising:

a receptacle having a top wall formed with a circular cross section collar surrounding a collar opening;

a hollow cylindrical central body received in said collar opening and formed with a bottom provided with at least one aperture communicating with an interior of said receptacle, and an annular flange at an upper end of said body engaging against an annular seal on said collar;

a filter element in said central body;

a protective cap fixed on said bottom of said central body and provided with at least one passage connecting said aperture with said interior of said receptacle;

a flat cover overlying said upper end of said central body, surrounding said flange and connected therewith by joining elements, communicating between an inner space of said central body and ambient atmosphere externally of said collar and said cover, said cylindrical central body, said protective cap and said cover being connected together; and a break-away element connected to said cover and rupturing upon opening of said cover, wherein said break-away element is a sheet cap extending over said cover and fastened to said cover at joining elements.

2. The vented container defined in claim 1 wherein said central body, said protective cap and said flat cover are composed of synthetic resin.

3. The vented container defined in claim 1 wherein said cover is formed on an upper side thereof with recesses shaped to accommodate a tool for opening said cover.

4. The vented container defined in claim 1 wherein a flow-resistant mat is applied over said apertures.

5. The vented container defined in claim 1 wherein a flow-resistant mat is applied over a hollow interior of said central body.

6. The vented container defined in claim 1 wherein a hollow interior of said central body contains said filter element.

7. The vented container defined in claim 1 wherein said cap is of conical configuration.

8. The vented container defined in claim 1 wherein said cap is of spherical segmental configuration.

9. The vented container defined in claim 1 wherein said cap is concave toward said interior.

10. The vented container defined in claim 1 wherein said cap is convex toward said interior.

11. The vented container defined in claim 1 wherein said body is provided on a screw cover adapted to be threaded onto said collar.

12. The vented container defined in claim 1 wherein said central body extends toward said interior beyond said bottom and defines an upper chamber containing said filter element above said bottom and a lower chamber below said bottom, said vented container further comprising a check valve between said upper and lower chambers.

13. The vented container defined in claim 12 wherein said protective cap is fixed to said body below said check valve.

14. A vented container for a flowable substance comprising:

a blow-molded receptacle of a plastic having a top wall formed with a circular cross section collar surrounding a collar opening, and an outlet at a bottom portion of said receptacle;

a hollow cylindrical central body of plastic received in said collar opening and formed with a bottom provided with at least one aperture communicating with an interior of said receptacle, and an annular flange at an upper end of said body engaging against an annular seal on said collar;

a filter element in said central body;

a protective cap of plastic fixed on said bottom of said central body and provided with at least one passage connecting said aperture with said interior of said receptacle;

a flat cover of plastic overlying said upper end of said central body, surrounding said flange and connected therewith by joining elements, said cover being formed in regions between said joining elements with venting slits communicating between an inner space of said central body and ambient atmosphere externally of said collar and said cover, said cylindrical central body, said protective cap and said cover being connected together; and a break-away element connected to said cover and rupturing upon opening of said cover, said cover being formed on an upper side thereof with recesses shaped to accommodate a tool for opening said cover, wherein said break-away element is a sheet cap extending over said cover and fastened to said cover at joining elements.

15. The vented container defined in claim 14 wherein said cap is of conical or spherical segmental configuration and said cap is concave or convex toward said interior.

16. The vented container defined in claim 14 wherein said central body extends toward said interior beyond said bottom and defines an upper chamber containing said filter element above said bottom and a lower chamber below said bottom, said vented container further comprising a check valve between said upper and lower chambers, and said protective cap is fixed to said body below said check valve.

17. The vented container defined in claim 14 wherein said body is provided on a screw cover adapted to be threaded onto said collar.

* * * * *